US009253846B2

(12) United States Patent
Sheu

(10) Patent No.: US 9,253,846 B2
(45) Date of Patent: Feb. 2, 2016

(54) LED TABLE LAMP

(71) Applicant: HON HAI PRECISION INDUSTRY CO., LTD., New Taipei (TW)

(72) Inventor: Yi-Zhong Sheu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 366 days.

(21) Appl. No.: 13/870,152

(22) Filed: Apr. 25, 2013

(65) Prior Publication Data

US 2014/0167624 A1 Jun. 19, 2014

(30) Foreign Application Priority Data

Dec. 19, 2012 (TW) ..... 101148538 A

(51) Int. Cl.

| | |
|---|---|
| ***F21S 6/00*** | (2006.01) |
| ***H05B 33/08*** | (2006.01) |
| ***F21V 23/04*** | (2006.01) |
| *F21Y 101/02* | (2006.01) |

(52) U.S. Cl.

CPC ..... *H05B 33/0854* (2013.01); *F21S 6/003* (2013.01); *F21V 23/0464* (2013.01); *F21Y 2101/02* (2013.01)

(58) Field of Classification Search

CPC ..... H05B 33/0854; H05B 33/0869; H05B 33/0872; F21S 6/002; F21S 6/003; F21V 23/0442; F21V 23/0464

See application file for complete search history.

(56) References Cited

U.S. PATENT DOCUMENTS

| | | | | |
|---|---|---|---|---|
| 2010/0295456 | A1* | 11/2010 | Ko | 315/154 |
| 2012/0038279 | A1* | 2/2012 | Chang et al. | 315/151 |
| 2014/0055990 | A1* | 2/2014 | Reed | 362/218 |

* cited by examiner

*Primary Examiner* — Patrick O'Neill

(74) *Attorney, Agent, or Firm* — Novak Druce Connolly Bove + Quigg LLP

(57) ABSTRACT

An exemplary LED table lamp includes a hollow lamp housing, a lamp base supporting the lamp housing, an LED module received in the lamp housing for emitting light, and a controlling module electrically connecting to the LED module for automatically adjusting a light intensity of the LED table lamp. The controlling module includes a sensor configured for sensing the light intensity of a working surface of the LED table lamp, and obtaining data corresponding to the light intensity of the working surface of the LED table lamp, a controller comparing the data obtained by the sensor with predetermined data and giving an adjusting order, and an adjusting member adjusting current supplied to the LED module according to the adjusting order from the controller.

17 Claims, 4 Drawing Sheets

LED TABLE LAMP

BACKGROUND

1. Technical Field

The disclosure relates to light emitting diode (LED) lamps for illumination purpose and, more particularly, relates to an improved LED table lamp capable of automatically adjusting light intensity.

2. Description of Related Art

LEDs have many beneficial characteristics, including low electrical power consumption, low heat generation, long lifetime, small volume, good impact resistance, fast response and excellent stability. These characteristics have enabled the LEDs to be widely used as a light source in electrical appliances and electronic devices. LEDs are also used as table lamps.

In use, the LEDs work in a stable state and light emitted form the LEDs illuminate a working surface. Generally, the LED table lamp includes an adjusting knob, the user adjusts the light intensity on the working surface by adjusting the knob manually. However, it may be inconvenient for the user to adjust the light intensity in real time when the brightness of the surroundings often changes.

What is needed, therefore, is an improved LED table lamp which overcomes the above described shortcomings.

DETAILED DESCRIPTION

An embodiment of an LED table lamp in accordance with the present disclosure will now be described in detail below and with reference to the drawings.

Figure 1:
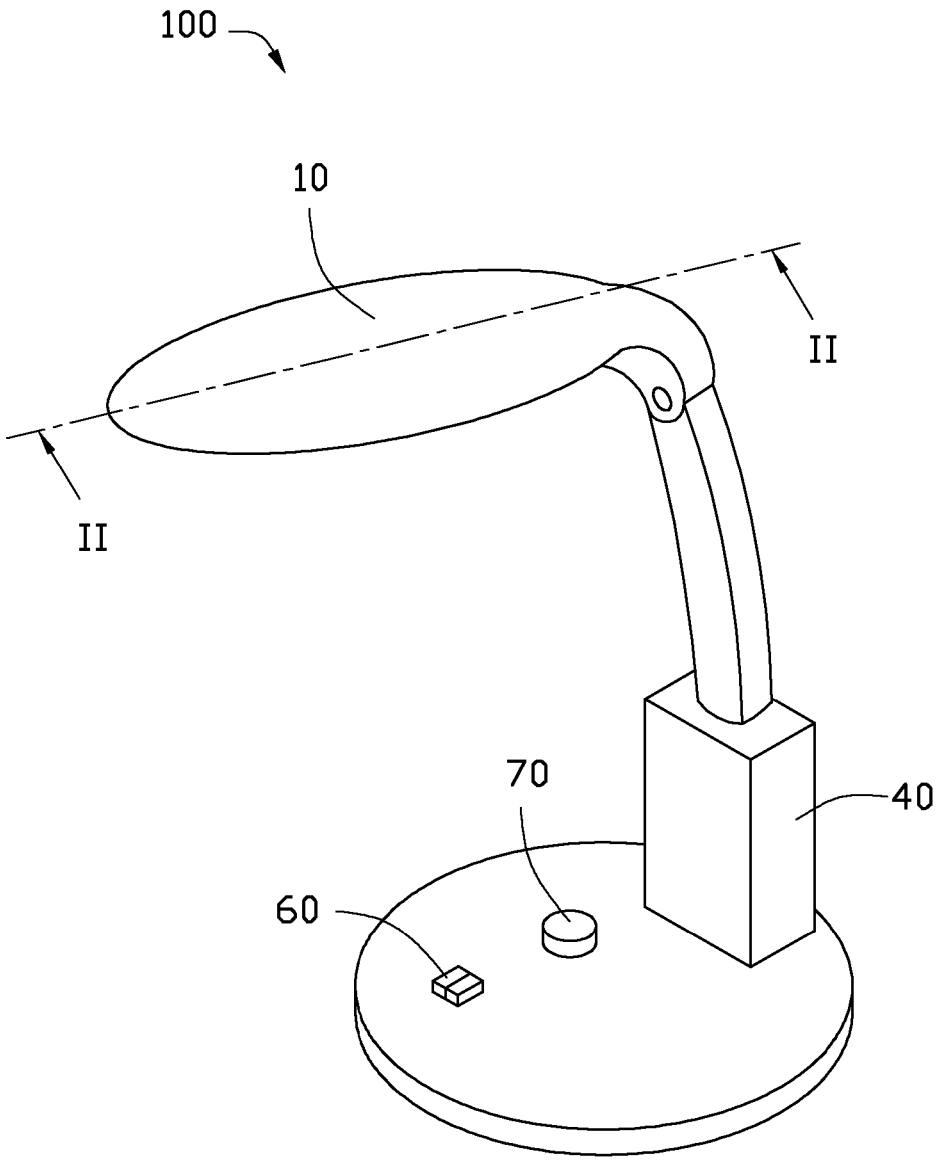
FIG. 1 is an isometric, assembled view of an LED table lamp according to an exemplary embodiment of the present disclosure.
Figure 2:
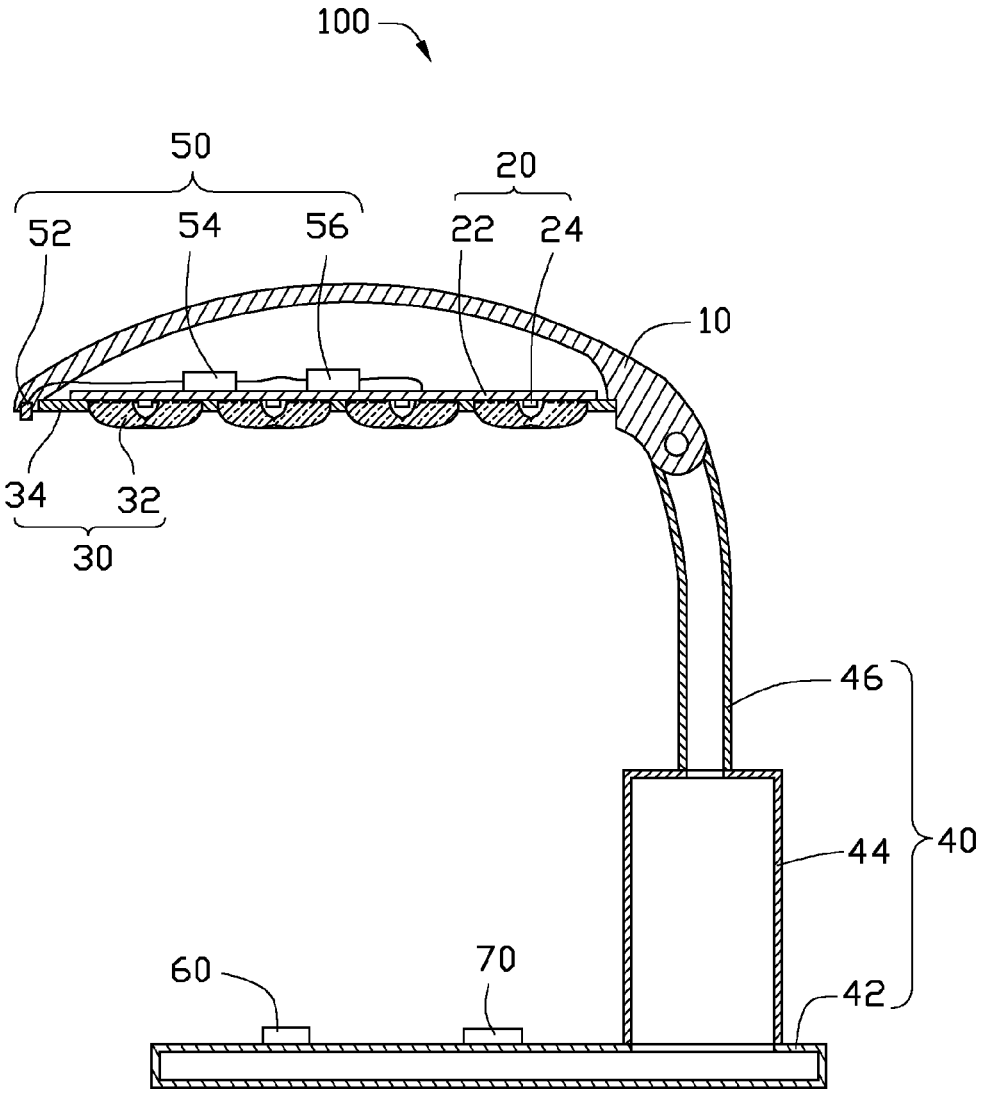
FIG. 2 is a cross-sectional view of the LED table lamp of FIG. 1, taken along line II-II thereof.

Referring to FIGS. 1 and 2, an LED table lamp 100 in accordance with an exemplary embodiment of the disclosure is illustrated. The LED table lamp 100 includes a lamp housing 10, an LED module 20 received in the lamp housing 10, a lens module 30 engaged with the LED module 20, a lamp base 40 supporting the lamp housing 10, and a controlling module 50 configured for automatically adjusting a light intensity of the LED table lamp 100.

The lamp housing 10 can be integrally made of plastic, resin, or glass etc. It can be understood that, the lamp housing 10 can be made of metal with high heat conductivity, such as aluminum, steel, iron, copper, or an alloy thereof, whereby the lamp housing 10 can also function as a heat sink. In this embodiment of the disclosure, the lamp housing 10 has a semi-oval configuration.

The LED module 20 includes an elongated printed circuit board 22 and a plurality of LEDs 24 mounted on the printed circuit board 22. The printed circuit board 22 is secured in the lamp housing 10. The LEDs 24 are arranged evenly on the printed circuit board 22 and spaced from each other.

The lens module 30 includes a plurality of lenses 32 each fixed on one of the LEDs 24 of the LED module 20 and an elongated securing board 34 securing the lenses 32 relative to the LED module 20. Each of the lenses 32 has a dome-like configuration. The securing board 34 defines a plurality of round fixing holes (not labeled) for extension of the lenses 32 therethrough. The securing board 34 is fixed on the printed circuit board 22 of the LED module 20. The lens 32 is integrally formed of a transparent material such as glass, resin or plastic.

Figure 3:
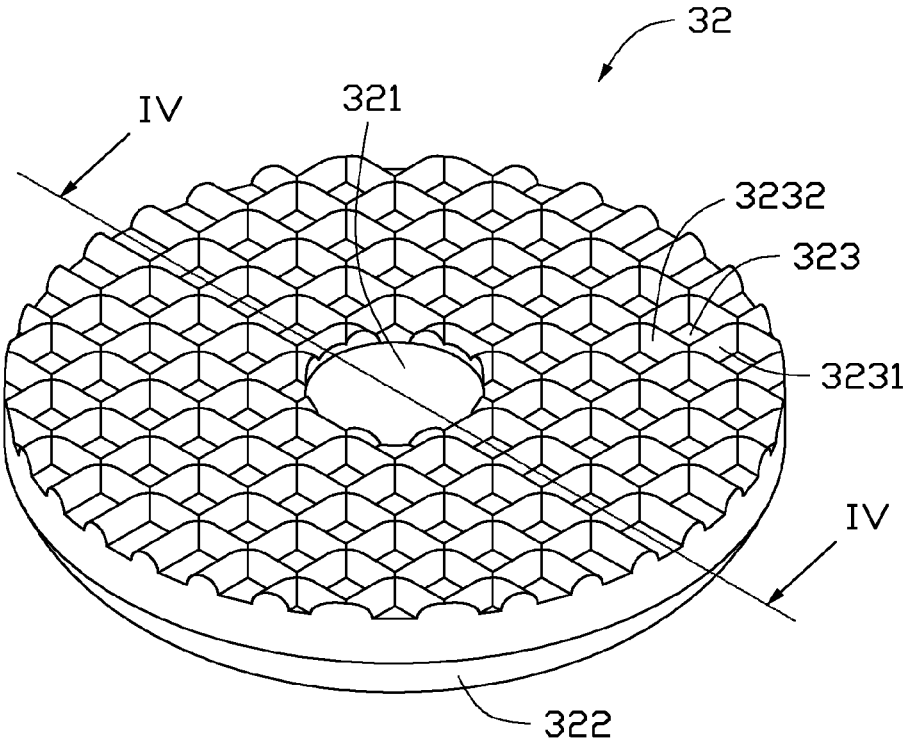
FIG. 3 is a schematic, enlarged view of an optical lens of the LED table lamp of FIG. 2.
Figure 4:
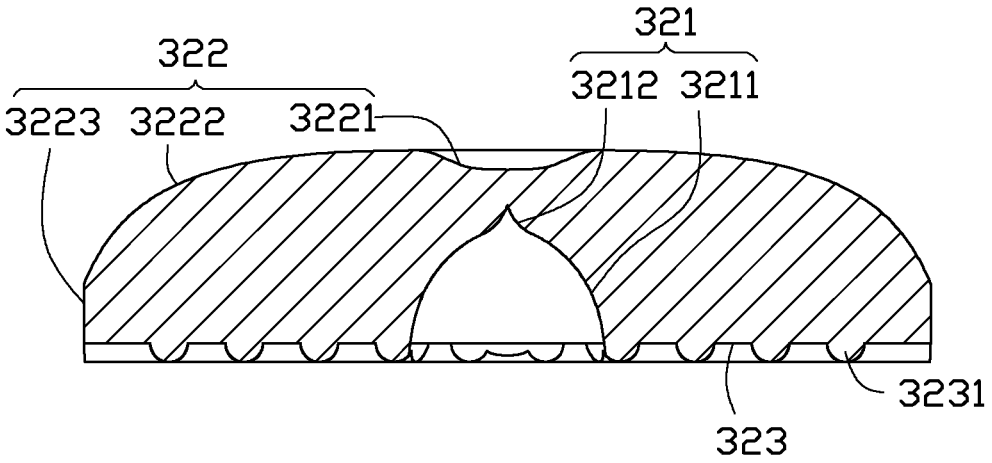
FIG. 4 is a cross-sectional view of the optical lens of FIG. 3, taken along line IV-IV thereof.

Referring to FIGS. 3 and 4 also, the lens 32 includes a first curved surface 321, a second curved surface 322 and a connecting surface 323 interconnected the first and second curved surfaces 321, 322. The second curved surface 322 covers the first curved surface 321. Bottoms of both the first and second curved surfaces 321, 322 are interconnected by the connecting surface 323.

The first curved surface 321 faces a corresponding LED 24. The first curved surface 321 includes a bottom portion 3211 and a top portion 3212. In this embodiment, a contour profile of the bottom portion 3211 is substantially an ellipsoid. The top portion 3212 further recesses upwardly into the lens 32 from a top of the bottom portion 3211. A slope of the cross-section of the bottom portion 3211 decreases along a direction from the connecting surface 323 to the top portion 3212. A slope of the cross-section of the top portion 3212 increases along a direction from the bottom portion 3211 to a top point of the top portion 3212. A top point is the top point of the top portion 3212 which is positioned on an optical axis of the lens 32 and a central axis of the LED 24. A bottom periphery of the first curved surface 321 is positioned on the connecting surface 323. In other words, a bottom edge of the bottom portion 3211 is positioned on the connecting surface 323. The top portion 3212 is used for diverging light radiated from the light source 10. When the light radiated from the LED 24 strikes on the first curved surface 321, part of the light at a center portion travels through the top portion 3212 and is refracted to lateral sides of the lens 32 to diverge the light from the center portion to lateral sides of the lens 32.

The second curved surface 322 is positioned on the first curved surface 321. A center point of the second curved surface 322 is directly on the optical axis of the lens 32 and the central axis of the LED 24. The second curved surface 322 includes a concave surface 3221 at a top center portion of the lens 32, an arcuate surface 3222 at a periphery side of the concave surface 3221, and an annual side surface 3223 around lateral sides of the lens 32. The arcuate surface 3222 interconnects the concave surface 3221 and the annual side surface 3223. The concave surface 3221 is located above the top point of the first curved surface 321 and the LED 24. The concave surface 3221 can be a concave circle surface recessed downwardly into the lens 32 to further diverge the light traveled through the concave surface 3221. The arcuate surface 3222 protrudes away from the LED 24. A radius of curvature of the arcuate surface 3222 is greater than that of the concave surface 3221. Bottom periphery sides of both the first and second curved surfaces 321, 322 are positioned on the connecting surface 323 and are interconnected by the connecting surface 323.

A plurality of protruding bars are interlaced formed on the connecting surface 323. The protruding bars protrude downwardly from the connecting surface 323 and away from the concave surface 3221 of the second curved surface 322. The protruding bars include a plurality of first protrusions 3231 and a plurality of second protrusions 3232. The first protrusions 3231 are parallel to and spaced from each other, and the second protrusions 3232 are parallel to and spaced from each other. A shape of each first protrusion 3231 is the same as that of the second protrusions 3232. Both the first protrusion 3231 and the second protrusion 3232 are semi-terete. Take one first protrusion 3231 for example, a shape of cross-section of the first protrusion 3231 is a semi-circle. A centre of the semi-circle is located on the connecting surface 323. A radius of the semicircular first protrusion 3231 is 0.1 millimeter (mm) In other words, a distance between a point on the first protrusion 3231 protruded farthest from the connecting surface 323 and the connecting surface 323 is 0.1 mm. The first protrusions 3231 are arranged on the connecting surface 323 in linear array with an interval of 0.6 mm between two adjacent first protrusions 3231. In other words, a distance between the centers of each two adjacent first protrusions 3231 is 0.6 mm. In this embodiment, the second protrusions 3232 are parallel to each other and vertically intersect the first protrusions 3231. A distance between the centers of each two adjacent second protrusions 3232 is 0.6 mm. The first protrusions 3231 and the second protrusions 3232 are interlaced with each other to present a "#" shape.

When light radiated from the LED 24 passes through the lens 32, part of the light travels in the lens 32 and strikes on the first protrusions 3231 and the second protrusions 3232. The light strikes on the semicircular first and second protrusions 3231, 3232 with different incident angles. Each point of the first and second protrusions 3231, 3232 has different tangents. Thus, the light is reflected by the first protrusions 3231 and the second protrusions 3232 to different directions to increase outputting angles of the light and distribute the light evenly.

The lamp base 40 includes a seat 42, a supporting portion 44 extending upwardly from the seat 42, and a connecting rod 46 extending upwardly from the supporting portion 44 and connected to the lamp housing 10. The seat 42 is disc-shaped. The seat 42 and the supporting portion 44 are integrally formed of plastic or metal. The connecting rod 46 is movably connected to the lamp housing 10 in a manner of pivoting or link rod connecting. The connecting rod 46 is an elastic rod.

The controlling module 50 includes a sensor 52, a controller 54 and an adjusting member 56. The sensor 52 is fixed on the lamp housing 10. The sensor 52 is located outsides an illumination scope of the LED module 20. The sensor 52 is for sensing light intensity of a working surface of the LED table lamp 100. The sensor 52 is in a height corresponding to eyes of a user of the LED table lamp 100, and obtains data. The sensor 52 converts the obtained data to signals and transmits the signals to the controller 54. The controller 54 compares the obtained data with predetermined data and gives an adjusting order, the adjusting member 56 adjusts the current supplied to the LED module 20 according to the adjusting order from the controller 54, to amplify or decrease the light intensity of the LED module 20. When the obtained data are in accord with the predetermined data, the controller 54 stops to give the adjusting order to the adjusting member 56, and the LED module 20 works in a stable state. In use, the sensor 52 continually senses the light intensity and converts the obtained data to signals and transmits the signals to the controller 54, whereby the controller 54 could control the light intensity via the adjusting member 56 in real time.

The LED table lamp 100 further includes a switch module 60 for selecting automatic mode and manual mode, if the user selects the automatic mode, the controlling module 50 automatically adjust the light intensity in foresaid process according to the predetermined data which are set up by the user; if the user selects the manual mode, the LED table lamp 100 further includes an adjusting knob 70, the user adjusts the light intensity via the adjusting knob 70 manually.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED table lamp comprising:

a hollow lamp housing;

a lamp base supporting the lamp housing;

an LED module received in the lamp housing for emitting light; and a controlling module electrically connecting to the LED module for automatically adjusting a light intensity of the LED table lamp, the controlling module comprising:

a sensor configured for sensing the light intensity of a working surface of the LED table lamp, and obtaining data corresponding to the light intensity of the working surface of the LED table lamp;

a controller comparing the data obtained by the sensor with predetermined data, and sending an adjusting request;

an adjusting member adjusting electrical currents to the LED module according to the adjusting request from the controller; and a lens module engaging with the LED module;

wherein the LED module comprises a printed circuit board and plurality of LEDs mounted on the printed circuit board;

wherein the lens module comprises a plurality of lenses each fixed on each of the plurality of LEDs and a securing board configured to secure the lenses to the LED module; and wherein the lens comprise a first curved surface, a second curved surface covering the first curved surface a connecting surface interconnecting bottoms of the first curved surface and the second curved surface, and a plurality of the first protrusions and second protrusions formed on the connecting surface, the first protrusions and the second protrusions each being semi-terete, the first protrusions intersecting the second protrusions.

2. The LED table lamp of claim 1, wherein the sensor is fixed on the lamp housing.

3. The LED table lamp of claim 1, wherein the sensor is located outsides an illumination scope of the LED module.

4. The LED table lamp of claim 1, wherein the sensor continually senses the light intensity, converts the obtained data to signals and transmits the signals to the controller, whereby the controller adjusts the light intensity via the adjusting member in real time.

5. The LED table lamp of claim 1, further comprising a switch module adapted for selecting automatic mode and manual mode.

6. The LED table lamp of claim 1, wherein each of the plurality of lenses is dome-shaped.

7. The LED table lamp of claim 1, wherein the securing board defines a plurality of round fixing holes, each of the plurality of lenses is configured to extend through each of the plurality of round fixing holes.

8. The LED table lamp of claim 1, wherein the securing board is fixed on the printed circuit board of the LED module.

9. The LED table lamp of claim 1, wherein the first protrusions are parallel to and spaced from each other, and the second protrusions are parallel to and spaced from each other.

10. The LED table lamp of claim 1, wherein a center of each of the first protrusions is on the connecting surface.

11. The LED table lamp of claim 1, wherein a radial cross section of each of the first protrusions is a semi-circle with a radius of 0.1 mm, and a distance between adjacent two of the first protrusions is 0.6 mm.

12. The LED table lamp of claim 1, wherein a distance between the connecting surface and a point on the first protrusions protruded farthest from the connecting surface is 0.1 mm.

13. The LED table lamp of claim 1, wherein the first protrusions and the second protrusions are the same in configuration.

14. The LED table lamp of claim 13, wherein a distance between each adjacent two of the second protrusions is 0.6 mm.

15. The LED table lamp of claim 1, wherein the first protrusions intersect the second first protrusions vertically.

16. The LED table lamp of claim 1, wherein the first curved surface comprises a bottom portion recessing into the lens and a top portion further recessing into the lens from a top of the bottom portion, a slope of a cross-section of the bottom portion decreasing from the connecting surface to the top portion, and a slope of a cross-section of the top portion increasing from the bottom portion to a top of the top portion.

17. The LED table lamp of claim 1, wherein the second curved surface comprises a concave surface at a top center portion of the lens, an arcuate surface at a periphery side of the concave surface, and an annual side surface around lateral sides of the lens.

* * * * *